United States Patent [19]

Storm

[11] 4,073,593

[45] Feb. 14, 1978

[54] METHOD AND APPARATUS FOR PROVIDING A POWER SCREED BOARD

[75] Inventor: Nelson "Jack" Storm, Rossville, Ill.

[73] Assignee: Custom Trailers Mfg., Inc., Westville, Ill.

[21] Appl. No.: 704,297

[22] Filed: July 12, 1976

[51] Int. Cl.[2] ..... E01C 23/06

[52] U.S. Cl. ..... 404/114; 404/118

[58] Field of Search ..... 404/114.72, 118, 119; 259/1 R

[56] References Cited

U.S. PATENT DOCUMENTS

| | | | |
|---|---|---|---|
| 1,988,315 | 1/1935 | Jackson | 404/114 X |
| 2,306,126 | 12/1942 | Jackson | 404/114 |
| 2,314,985 | 3/1943 | Jackson | 404/114 |
| 2,542,979 | 2/1951 | Barnes | 404/114 |
| 2,693,136 | 11/1954 | Barnes | 404/114 |
| 3,118,353 | 1/1964 | Neil | 404/114 |
| 3,180,625 | 4/1965 | Wyzenbeek | 259/1 R |
| 3,408,876 | 11/1968 | Andrews | 259/1 R |
| 3,528,144 | 9/1970 | Haponski | 259/1 R X |
| 3,782,693 | 1/1974 | Strohbeck | 259/1 R |

*Primary Examiner*—Nile C. Byers

*Attorney, Agent, or Firm*—Dominik, Knechtel, Godula & Demeur

[57] ABSTRACT

This invention relates generally to power screed boards or apparatus for leveling, settling and/or compacting material such as concrete. More particularly, it relates to a method and apparatus which can be easily and quickly removably secured to a length of board such as a 2×4 or the like to thereby adapt or convert the length of board to a power screed board.

3 Claims, 3 Drawing Figures

METHOD AND APPARATUS FOR PROVIDING A POWER SCREED BOARD

Power screed boards and similar apparatus presently are commercially available, and the use of them for and in leveling, settling and/or compacting material such as concrete is well-known. Most, if not all, of the commercially available units are designed and constructed for heavy duty use by, for example, contractors who do a large volume of business. As a result, these units are generally expensive and are far too costly for the contractor who is called upon for an occasional job of laying a concrete patio or the like, and particularly, the handyman who wants to do his own work.

SUMMARY OF THE INVENTION

The apparatus of the present invention can be easily and quickly removably secured to a length of board such as the 2×4 or the like thereby adapt or convert the length of board to a power screed board so as to provide a relatively light-weight, inexpensive power screed board. The apparatus, in its broadest aspect, simply includes a vibrator and a flexible coupler for coupling a source of power to the vibrator, although a complete apparatus obviously requires a source of power. More particularly, a portable electric hand drill preferably and advantageously can be used as a source of power, since most contractors, handymen and others usually have such a drill. The drill therefore can be used in at least a dual function, as a drill and as a source of power for the apparatus of the invention. A small electric motor also can be used, however, if desired.

The vibrator and the source of power both are adapted to be easily and quickly removably secured to a length of board such as a 2×4, a 2×6, or the like, to effectively adapt or convert the length of board to a power screed board.

In the illustrated embodiment, the vibrator is a vibrator of the type including a rotatable unbalanced element and, as indicated above, a source of power can be a portable, electric hand drill or a small electric motor. Vibrators of this type, and drills and electric motors all are readily available on the market. Appropriate clamps are provided to removably clamp the vibrator and the source of power to the length of board, and these clamps preferably and advantageously are welded or otherwise secured to the vibrator so that the clamps always are readily available and are not susceptible to being lost or misplaced.

The apparatus of the invention provides numerous advantages including but not limited to the fact that such vibrators are light weight and inexpensive, and the same is true with respect to the source of power, particularly when a portable electric hand drill is utilized. In the latter case, as previously indicated, the portable electric hand drill obviously can be used in a dual function, as a hand drill and as a source of power for the apparatus. Since the vibrator and the source of power both are light weight and are affixed to a length of board, a light weight power screed board that can be easily handled and manipulated by one person can be provided. The fact that such vibrators are inexpensive, particularly in comparison to the cost of present commerically available power screed boards, and the fact that the hand drill can be used in a dual function, results or provides a power screed board well within the price range economical to the small contractor or handyman.

Also, not only does the apparatus provide the advantage that virtually any length of board such as a 2×4, 2×6 or the like can be converted or adapted to a power screed board, the apparatus provides the further advantage that the length of the board can be selected for the particular job. Most, if not all, commercially available power screed boards are of a fixed size and thus do not provide this feature.

Accordingly, it is an object of the present invention to provide an improved method and apparatus whereby a length of board can be easily and quickly adapted and used as a power screed board.

A further object is to provide such apparatus which can be easily and quickly removably affixed to a length of board to thereby adapt or convert the length of board to a power screed board.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF A PREFERRED EMBODIMENT

Figures 1, 2, 3:
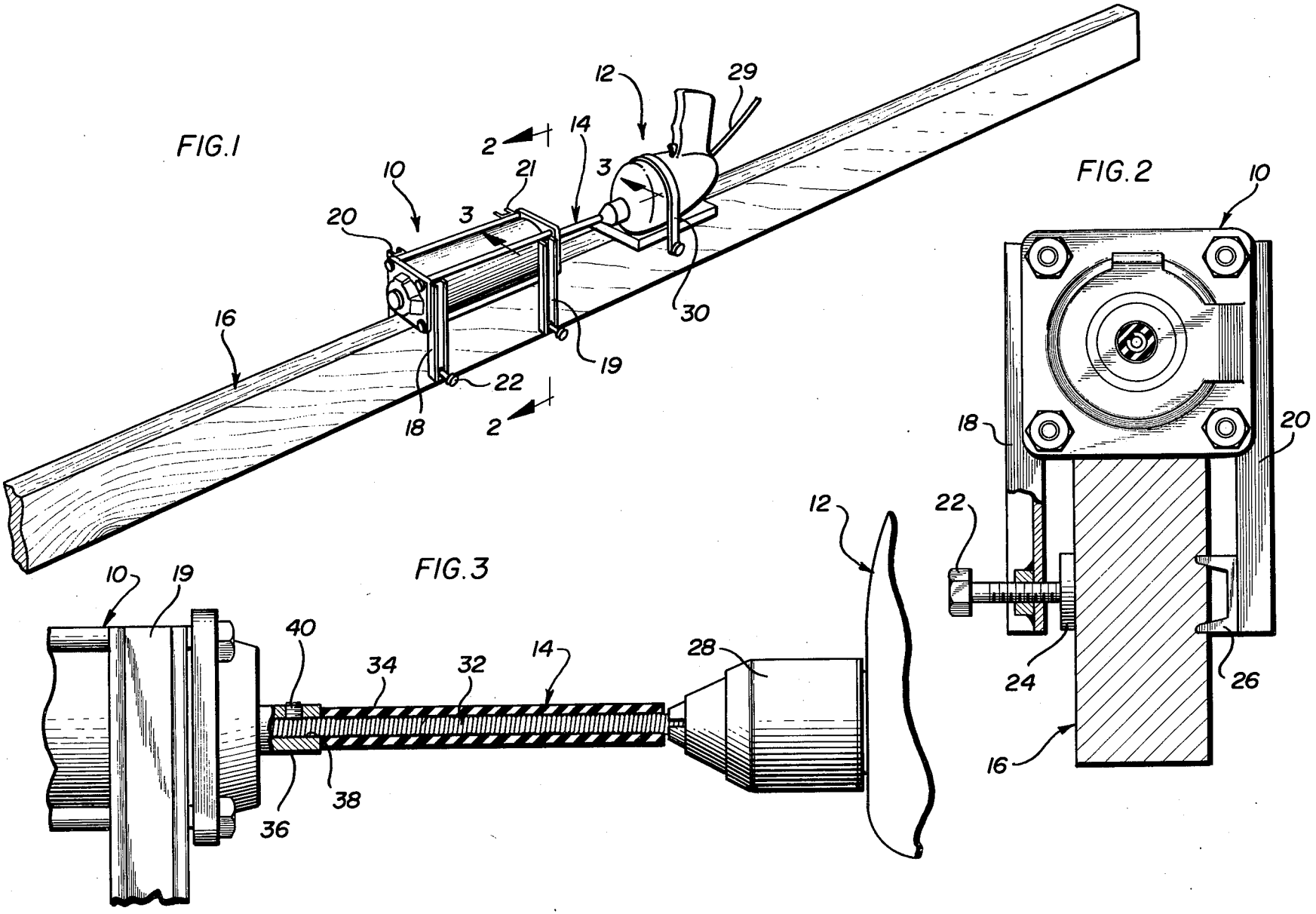
FIG. 1 is a perspective view generally illustrating the apparatus of the invention removably affixed to a length of board to convert or adapt the board to function as a power screed board.
FIG. 2 is a sectional view taken substantially along lines 2—2 of FIG. 1.
FIG. 3 is a partial side plan view, taken generally along lines 3—3 of FIG. 1, partially for sectionalized to illustrate the construction of the coupler for coupling the source of power to the vibrator.

Referring now to the drawing, in FIG. 1 the apparatus of the invention is illustrated affixed to a length of board 16 which may be virtually any type of board, such as, for example, a 2×4, a 2×6 or the like, which is capable of functioning as a screed board for leveling, settling and/or compacting materials, all as more fully described below. Generally, the apparatus includes a vibrator 10, a source of power 12 which in the illustrated embodiment is a portable electric hand drill and a coupler 14 for coupling the source of power 12 to the vibrator 10. While not shown, it will be obvious from the description below that the source of power 12 can as well comprise a small electric motor, for driving the vibrator 10. Bracket clamps 18–21 are provided for securing the vibrator 10 to the length of board 16. Correspondingly, a clamp 30 which may be, for example, a C-clamp also is provided for clamping the source of power 12 to the length of board 16.

More particularly, the vibrator 10 preferably and advantageously is a vibrator of the type including a housing within which there is contained an unbalanced rotating element that is rotatably secured therein. Vibrators of this type are generally well-known and are commercially available on the market place. The vibrator 10 is provided with clamps 18–21 for removably securing the vibrator 10 to the length of board 16. In the illustrated embodiment, the clamps 18 and 19 each comprise a generally U-shaped length of heavy gauge metal which is fixedly secured as by welding to the housing of the vibrator 10. Each of these brackets 18 and 19 have fastening means such as a threaded screw 22 threadedly secured therein, with the threaded screw 22 having a foot or base 24 on its one terminal end for engagement with the length of board 16. The brackets 20 and 21 are generally like the brackets 18 and 19 and are also fixedly secured to the housing of the vibrator 10. These brackets 20 and 21 however, preferably and advantageously have a generally U-shaped clamp member 26 fixedly secured to them, in a fashion such that the two legs thereof are generally forcibly imbedded in the length of board 16 when the vibrator 10 is removably secured to the length of board 16, as generally illustrated in FIG. 2. Obviously, in securing the vibrator 10 to the length of board 16, the length of board 16 is extended between the brackets 18 and 19 and 20 and 21, as illustrated, and the threaded screws 22 of the brackets 18 and 19 are threadedly manipulated to fixedly removably secure the vibrator 10 to the length of board 16.

The source of power 12, as indicated above, preferably and advantageously is a portable electric hand drill which is energized by plugging its power cord 29 into any available 110 volt power source. The portable electric hand drill 12 is removably secured to the length of board 16 in operative relationship with the vibrator 10, by means of a clamp 30 which can be, for example, a C-clamp. A portable electric hand drill makes a very convenient source of power for driving the vibrator 10, since the drill not only can be used as a source of power for the vibrator 10, but also can be used in its normal fashion as a hand drill. Accordingly, the portable electric hand drill performs at least a dual function. However, as previously indicated, a small electric motor can be used, if desired.

The source of power 12 is coupled to the vibrator 10 by means of a coupler 14 which preferably and advantageously comprises a length of flexible metallic shaft 32. The one end of the flexible metallic shaft 32 is extended into a bore 38 provided in the end of the shaft 36 comprising the unbalanced rotatable element within the housing of the vibrator 10, and the end is secured within the bory by means of a set screw 40 or the like. When an electric portable hand drill is used, the opposite end of the flexible metallic shaft 32 can be secured within the chuck 28 of the drill, in generally the same fashion as the drill bit is secured therein. Also, a rubber tube or sleeve 34 preferably and advantageously is provided over the flexible metallic shaft, and this sleeve 34 not only functions as a support but as a free spinning safety shield in case a shirt sleeve, pant leg, and the like would come in contact with the flexible shaft during operation.

Accordingly, from the above description, it can be seen that the apparatus of the present invention provides an arrangement and method whereby virtually any length of board which is capable of functioning as a screed board can be easily and quickly adapted to provide a power screed board. The length of board can be adapted to the particular job, and the resulting screed board is relatively light weight in comparison to most commercially available power screed boards, so that it can be manipulated by one man. More importantly, a power screed board which is relatively inexpensive in comparison to presently available commercial power screed boards is provided. Further still, when a portable electric hand drill is provided as a source of power for the vibrator 10, the portable electric hand drill provides the further advantage of being usable in its intended fashion, as a drill.

It will thus be seen that the objects set forth above, among those made apparent from the preceding description, are efficiently attained and certain changes may be made in carrying out the above method and in the construction set forth. Accordingly, it is intended that all matter contained in the above description or shown in the accompanying drawings shall be interpreted as illustrative and not in a limiting sense.

Now that the invention has been described, what is claimed as new and desired to be secured by Letters Patent is:

1. A power screed of the type having a screed board, a vibration element for vibrating said screed board, and a source of power for operating said vibration element, said power screed being of a knock-down construction for on-site assembly and disassembly and comprising, in combination, a length of board usable as a temporary screed board, whereby a disposable and replaceable length of board suitably proportioned for a particular job can be simply selected for the screed board; a light-weight vibration element having a housing, an unbalanced rotating element rotatably retained within said housing, and adjustable clamping means integrally formed with said housing for quickly and detachably clamping said vibrator to said length of board, whereby said vibration element is detachable and useable in conjunction with any selected length of board; and a light-weight power hand drill providing a source of power for said vibration element and adapted to be quickly and detachably affixed to said selected length of board and detachably coupled to said vibration element, whereby said source of power is detachable and useable in conjunction with any such vibration element; whereby an inexpensive, light-weight power screed of a knock-down construction for on-site assembly and disassembly is provided simply by selecting any available suitable length of board and detachably clamping the vibration element and the source of power to it and then coupling the vibration element and the source of power together.

2. The power screed of claim 1, further comprising a flexible shaft for coupling said vibration element and said source of power together.

3. The power screed of claim 1, further comprising a resilient tubular sleeve about said flexible shaft.

* * * * *